US007481554B2

(12) United States Patent
Anderson et al.

(10) Patent No.: US 7,481,554 B2
(45) Date of Patent: Jan. 27, 2009

(54) BATTERY POWERED LED LAMP

(76) Inventors: Gary Anderson, 2005 Upton Ave. South, Minneapolis, MN (US) 55405; Ron Rothman, 414 S. Arlington Ave., Duluth, MN (US) 55811

( * ) Notice: Subject to any disclaimer, the term of this patent is extended or adjusted under 35 U.S.C. 154(b) by 131 days.

(21) Appl. No.: 11/532,440

(22) Filed: Sep. 15, 2006

(65) Prior Publication Data

US 2007/0058365 A1 Mar. 15, 2007

Related U.S. Application Data

(60) Provisional application No. 60/717,308, filed on Sep. 15, 2005.

(51) Int. Cl.
*F21V 21/14* (2006.01)

(52) U.S. Cl. ..... 362/250; 362/183; 362/198; 362/234; 362/411

(58) Field of Classification Search ..... 362/183, 362/198, 234, 250, 411
See application file for complete search history.

(56) References Cited

U.S. PATENT DOCUMENTS

| | | | | |
|---|---|---|---|---|
| 4,432,042 | A | 2/1984 | Zeller | |
| 4,885,667 | A | 12/1989 | Selden | |
| 5,172,974 | A | 12/1992 | Riban | |
| 5,653,529 | A * | 8/1997 | Spocharski | 362/235 |
| 5,994,791 | A * | 11/1999 | Rayner | 307/31 |
| 6,318,879 | B1 | 11/2001 | Huang | |
| 6,322,226 | B1 | 11/2001 | Dickson | |
| 6,402,339 | B1 | 6/2002 | Mukogawa et al. | |
| 6,808,289 | B2 * | 10/2004 | Reed | 362/198 |
| 7,066,621 | B2 | 6/2006 | Booty | |
| 7,075,250 | B2 | 7/2006 | Colwell | |
| D529,651 | S | 10/2006 | Chan | |
| D544,124 | S | 6/2007 | Chan | |
| 7,268,690 | B2 | 9/2007 | Nguyen et al. | |
| 2005/0007778 | A1 * | 1/2005 | Lin | 362/250 |

* cited by examiner

*Primary Examiner*—Sandra O'Shea
*Assistant Examiner*—James W Cranson
(74) *Attorney, Agent, or Firm*—Patterson, Thuente, Skaar & Christensen PA

(57) ABSTRACT

A battery powered LED lamp including an array of high-performance LEDs disposed in a lightweight directionally oriented shade. Converting electronics are provided which may include a step-down DC voltage switching regulator for converting a higher voltage of the battery power source to a lower voltage required to drive the LEDs at greater than 90% efficiency. The converting electronics may also include an LED current monitoring circuit for preventing thermal run-away of the LEDs and for reliably operating the LEDs near their maximum rating so to provide the maximum amount of brightness from the LED array and maximum battery life.

20 Claims, 9 Drawing Sheets

BATTERY POWERED LED LAMP

RELATED APPLICATIONS

This application claims the benefit of U.S. Provisional Patent Application No. 60/717,308, entitled BATTERY POWERED LED LAMP, filed Sep. 15, 2005, and hereby fully incorporated herein by reference.

FIELD OF THE INVENTION

The present invention relates to electronic lighting devices and more specifically to lighting devices using light emitting diodes (LEDs) as an illumination source.

BACKGROUND OF THE INVENTION

It is often desirable to use printed materials in low ambient light venues. For example, musicians sometimes need to read sheet music in performances at concerts, theatrical productions, clubs and other venues where house lighting may be low or non-existent. Further, it is sometimes desirable to read books and consult printed materials in locations where ambient lighting is insufficient for comfortable reading, as for example, at night in an automobile. Prior attempts at providing a lighting source for such venues have not been entirely successful.

In some prior devices, incandescent bulbs, powered by batteries or AC power have been used. Incandescent sources, while being relatively inexpensive, also have the drawback of relatively low energy utilization efficiency. This low efficiency results in low light level for amount of power consumed, as well as excessive heat production in the bulb. For battery powered devices, batteries are quickly depleted requiring frequent replacement for alkaline batteries, and frequent recharging for rechargeable type batteries. Moreover, AC power lamps have the drawback of requiring a nearby AC power source. An AC power source is often not readily available in locations where a lamp is desirably used, for example in automobiles. Also, a bulky power cord sometimes including a transformer is required. Further, incandescent bulbs have a relative short service life and require frequent replacement.

Other prior devices have used fluorescent bulbs. These devices have an advantage over incandescent devices in that they typically have better overall energy utilization and run cooler. A drawback, however, is the generally bulky and relatively heavy ballast required for fluorescent bulbs. Also, while having a much longer life than incandescent bulbs, fluorescent bulbs contain mercury and other harmful substances, requiring specialized disposal when the bulb is replaced.

In recent years, LED's have emerged as a viable, low power, relatively high brightness light source for portable lamps. Prior compact LED lamps, however, have generally suffered from a number of drawbacks. In these devices, inexpensive LEDs having a relatively low light output are used in an effort to save cost and provide acceptable battery life. In these devices, the light is usually of poor quality even with fully charged batteries, and has poor overall color and temperature characteristics. The quality of light from these devices degrades quickly as the batteries are discharged.

Just as significant is the poor overall energy consumption efficency of prior simple LED driving circuits. These circuits are usually no more than a power source connected directly to an LED with a current limiting resistance inserted in series. These simpler circuits dissipate electrical energy in the form of heat via the series resistance. The energy loss is proportional to the voltage drop across the series resistance. The voltage drop across the series resistance is essentially the difference in the power source voltage and the voltage required to drive the LED's. For a battery power source, the highest energy loss occurs upon utilizing fresh batteries as this is when the power source voltage is at its highest. For example, given a 6VDC power source, 11 ohm series resistance and 3.25VDC LED voltage, total power consumption of the circuit would be 1.5 Watts of which 0.6875 Watts is dissipated as heat across the series resistance and 0.8125 Watts of useful LED light power. This calculates to 54% efficiency.

As a result of the low efficiency of prior LED lamps, frequent battery replacement or recharging is required in battery powered devices to maintain an acceptable light level. AC powered LED lamp devices have been developed which alleviate the problems with battery usage, but these devices suffer from many of the same deficiencies as AC powered incandescent devices.

What is needed in the industry is a compact, battery powered lamp that alleviates the limitations of prior devices.

SUMMARY OF THE INVENTION

The present invention is a compact battery powered LED lamp that addresses the aforementioned needs of the industry. In an embodiment of the invention, an array of high-performance LEDs is disposed in a lightweight directionally oriented shade. The shade may be coupled with a clip or other attaching element for attaching the lamp to a music stand or other item such as a book. A flexible and selectively positionable gooseneck may be used for coupling the shade and attaching element.

According to an embodiment of the invention, converting electronics are provided which may include a step-down DC voltage switching regulator IC. This IC regulator converts the higher voltage of the battery power source to the lower voltage required to drive the LEDs at greater than 90% efficiency.

The converting electronics may also include an LED current monitoring circuit for preventing thermal runaway of the LEDs. This circuit reduces the voltage applied to the LEDs as the LED's temperature rises, thereby reaching a stable condition. The current monitoring circuit may include a low valued current sensing resistor in series with the LEDs, forming a feedback loop to the threshold voltage input pin of the switching regulator.

A benefit of the current monitor circuit incorporated in the converting electronics of embodiments of the invention is to reliably operate the LEDs near their maximum rating so to provide the maximum amount of brightness from the LED array. Simple provisions via a potentiometer arrangement within the current monitoring circuit provide a user adjustable LED light dimming capability without a reduction in overall efficiency. For a battery power source, reducing the light brightness yields longer operating times due to lower battery energy consumption.

An advantage of embodiments of the invention is that a relatively constant light output level is maintained throughout the life of the batteries. In some embodiments, from 9 to 45 hours of operation may be achieved before any dimming of the light output is encountered or the batteries are depleted.

In other embodiments of the invention, a battery charging circuit is incorporated in a housing and attachment clip assembly. A lithium-ion or other high performance battery may be also enclosed in the housing. The battery charging circuit may include digital logic enabling rapid and safe charging of the battery.

In other embodiments, the LED lamp may include a shade with a translucent or transparent lower edge flange to refract light emitted from the LEDs. The flange may appear luminescent, forming a neon-like ring around the lower edge of the shade when the LEDs are lit.

DETAILED DESCRIPTION OF THE PREFERRED EMBODIMENTS

Figure 1:
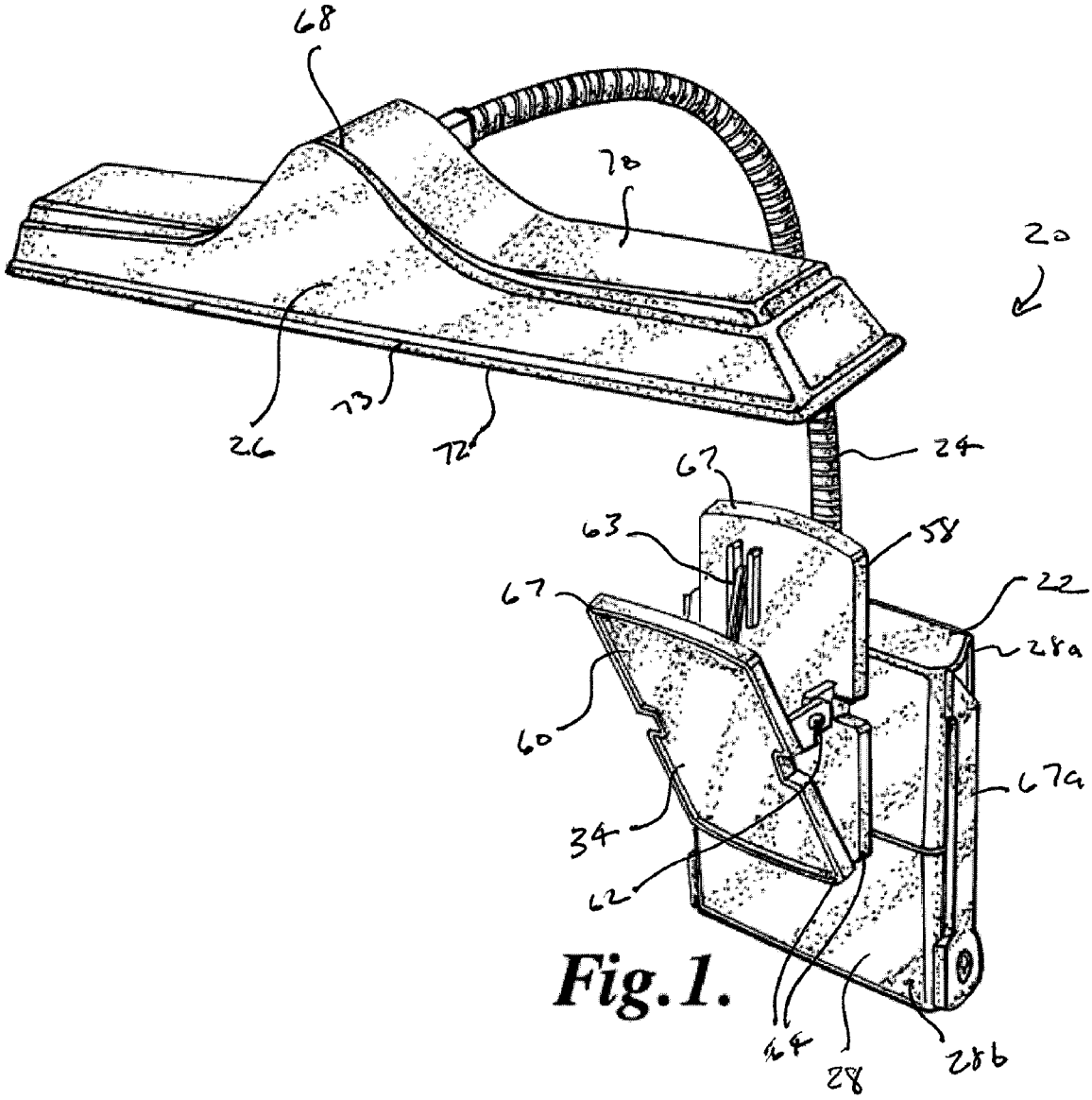
FIG. 1 is a perspective view of an embodiment of an LED lamp according to an embodiment of the present invention.
Figure 1A:
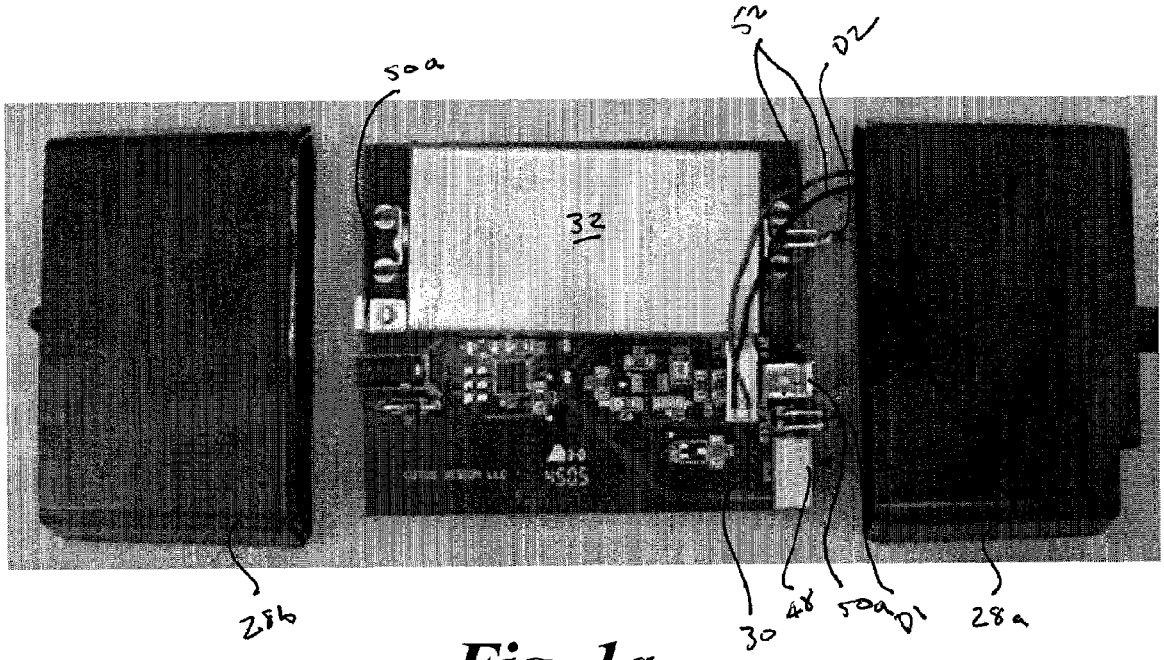
FIG. 1*a* is an exploded view of a power pack assembly of an LED lamp according to an embodiment of the present invention.
Figure 3:
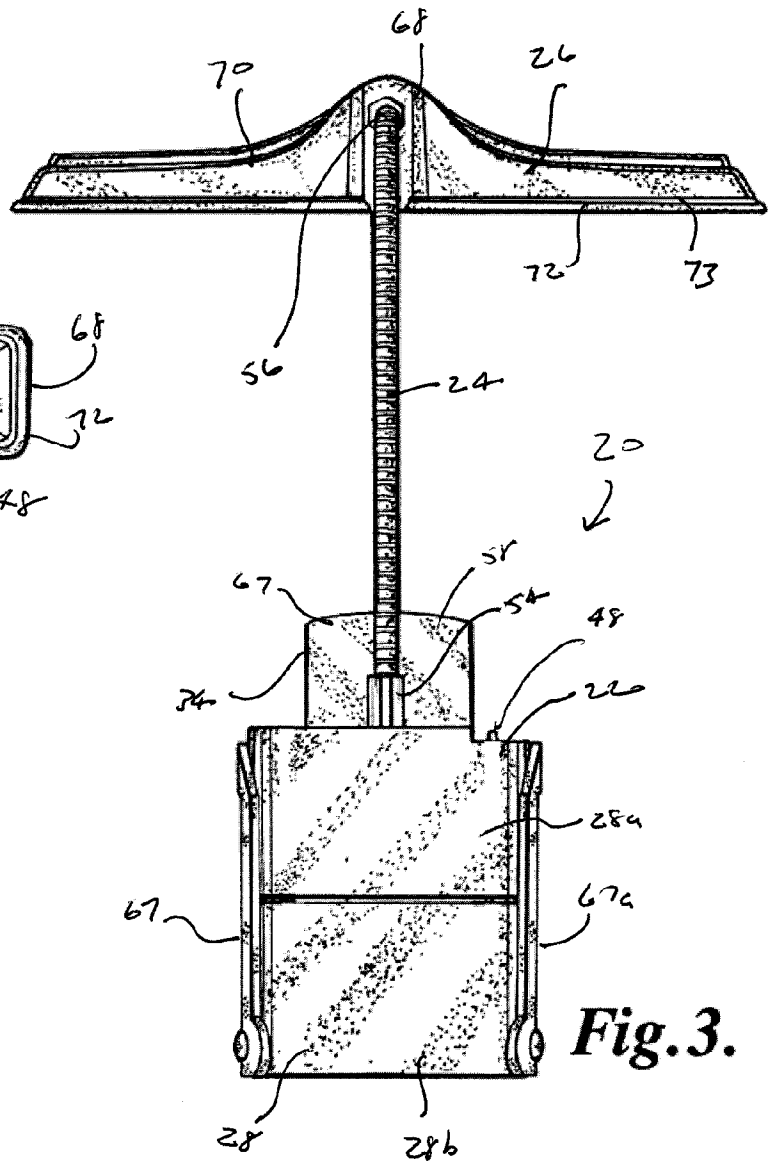
FIG. 3 is a rear elevation view of the LED lamp depicted in FIG. 1.

As depicted in FIGS. 1-10, an embodiment of the LED lamp 20 of the present invention generally includes power pack assembly 22, gooseneck 24, and shade assembly 26. Power pack assembly 22 generally includes housing 28, which may be formed in two halves 28*a*, 28*b*, and circuit board assembly 30, which may include battery 32, and attachment element 34. Housing 28 may be formed from lightweight polymer or other suitable material and is of sufficient size to house circuit board assembly 30 as well as other any electronics for lamp operation.

Figure 11:
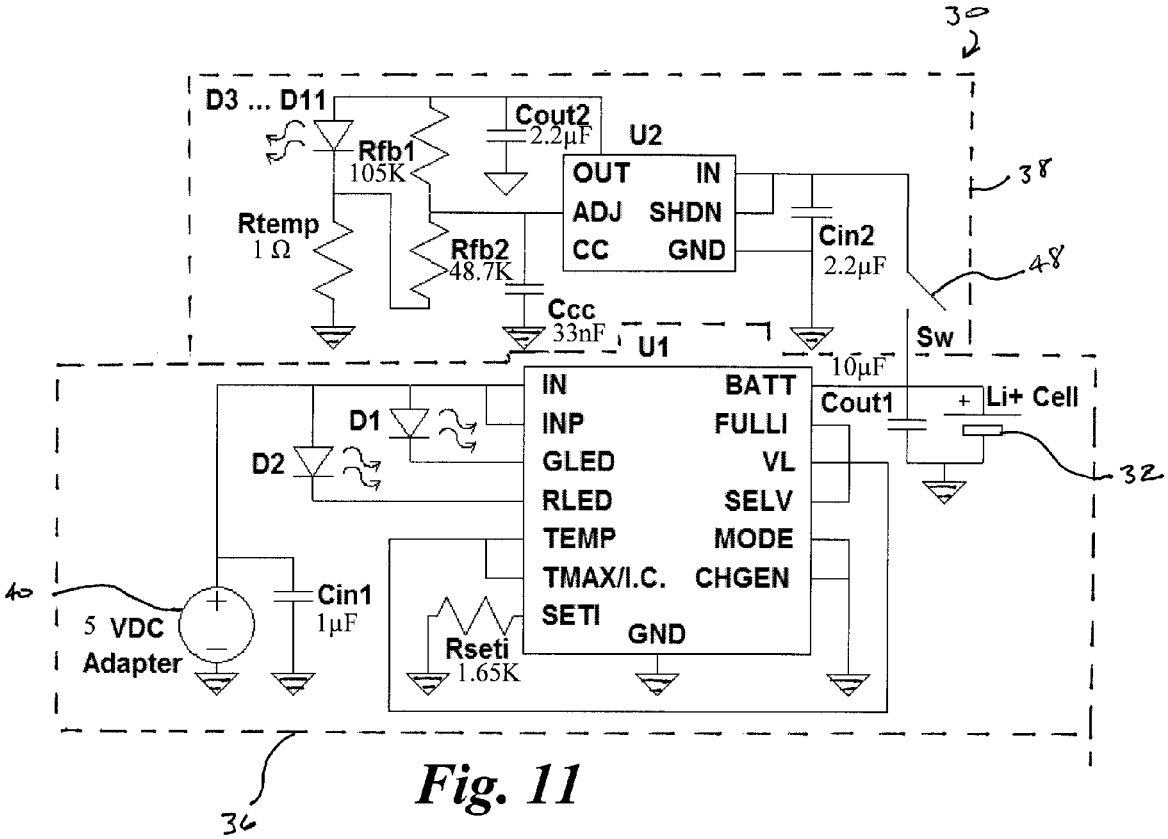
FIG. 11 is a schematic diagram of a circuit board assembly of an embodiment of an LED lamp according to the present invention.

In an embodiment depicted schematically in FIG. 11, circuit board assembly 30 generally includes charging circuit 36 and regulator and light circuit 38. Charging circuit 36 functions to recharge rechargeable battery 32 from a power source, which may be a regulated DC adapter coupled with a 110V or 240V AC house system, connected through input jack 40. In an embodiment, charging circuit includes a Maxim/Dallas MAX1501ETE highly integrated, linear battery charger with thermal regulation, available from Maxim/Dallas Direct! at www.maxim-ic.com for integrated circuit U1. It will be appreciated, however, that any other suitable circuit for battery charging may be used while remaining within the scope of the present invention. Further, in an embodiment, rechargeable battery 32 is a single cell high performance lithium-ion (Li+) battery as is commonly available in the art. It will be appreciated, however, that rechargeable battery 32 may also be any other type of rechargeable battery as may be known in the art, including without limitation, nickel-metal hydride (NiMH) or nickel-cadmium (NiCd).

In the embodiment of FIG. 11, LED D1 is green in color, and LED D2 is red in color. Each of LEDs D1 and D2 are visible from outside housing 28 through apertures 42, 44, respectively. LED D1 is used to indicate a full charge condition of rechargeable battery 32 and LED D2 is used to indicate that battery charging is in progress.

Regulator and light circuit 38 generally includes lighting LEDs 46, denoted as D3-D11 in schematic FIG. 11, regulator integrated circuit U2 and on/off/intensity switch 48. In an embodiment, LEDs 46 are model NSCW455AT white LEDs made by Nichia Corporation. LEDs 46 have been found to provide a light having a temperature and other qualities particularly suitable for illuminating music scores and books for reading. As depicted in the embodiments of FIGS. 2, 10, 11, and 12, nine of LEDs 46 are used to provide an amount and quality of light suitable for music reading. It will of course be appreciated that other types and numbers of suitable LEDs could be used while remaining within the scope of the present invention.

Figure 2:
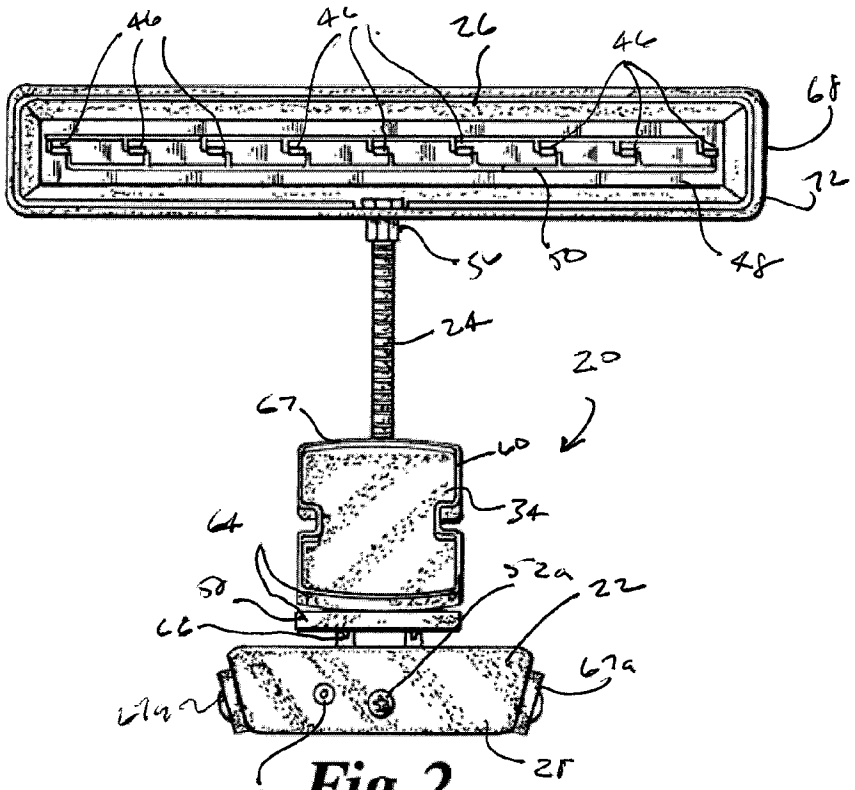
FIG. 2 is a bottom plan view of the LED lamp depicted in FIG. 1.
Figures 4, 5:
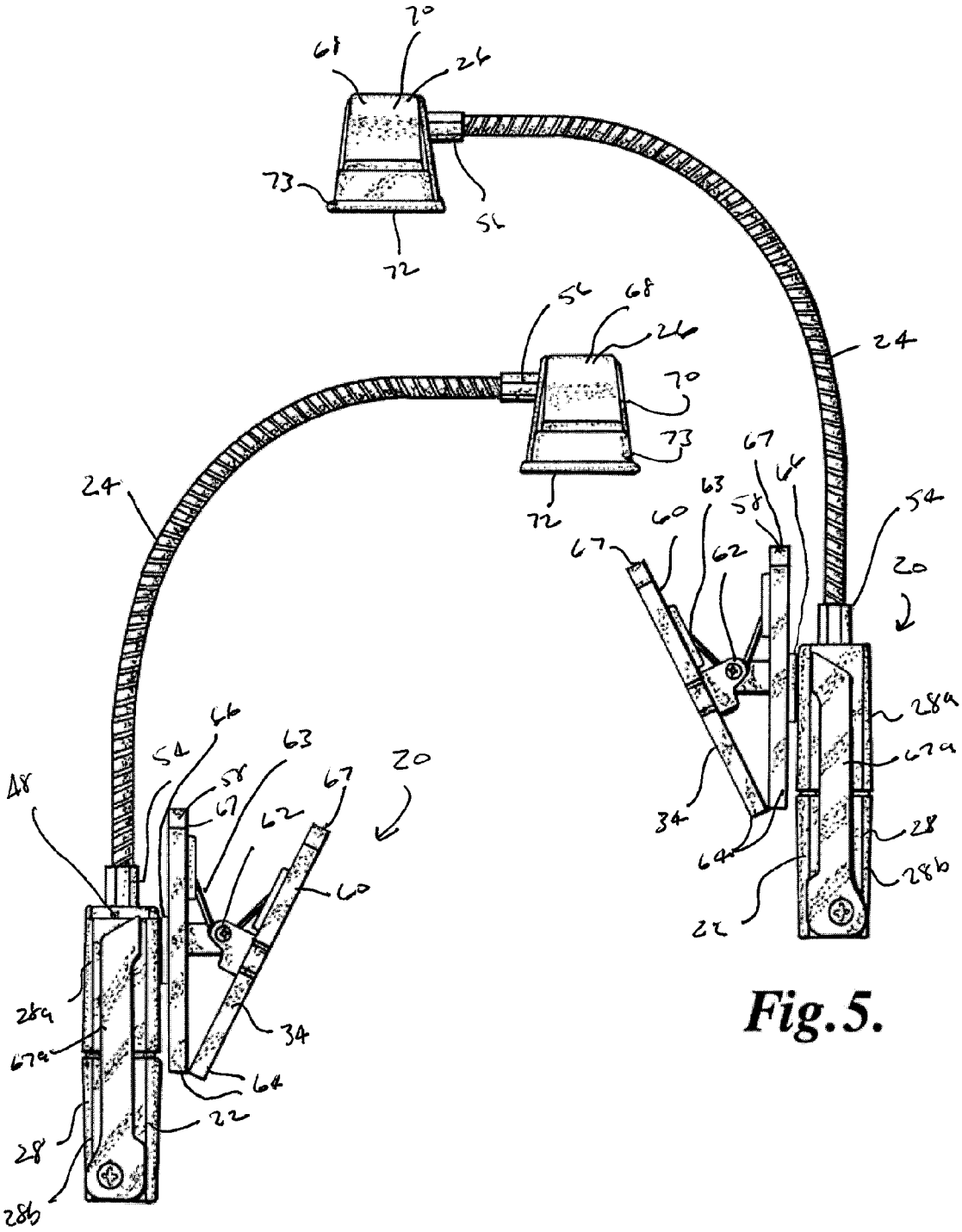
FIG. 4 is a side elevation view of the LED lamp depicted in FIG. 1.
FIG. 5 is an opposite side elevation view of the LED lamp depicted in FIG. 1.
Figures 6, 7:
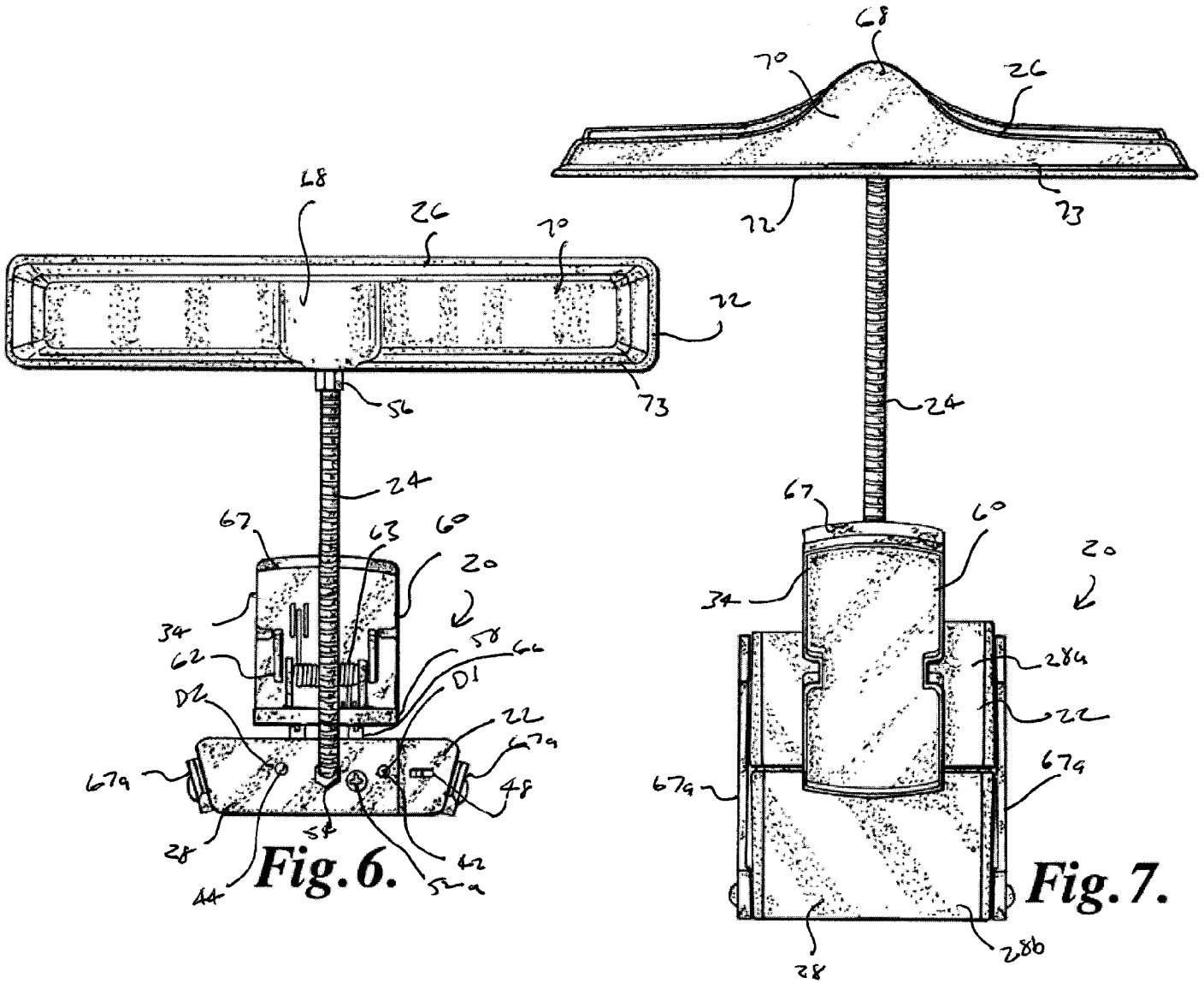
FIG. 6 is a top plan view of the LED lamp depicted in FIG. 1.
FIG. 7 is a front elevation view of the LED lamp depicted in FIG. 1.
Figure 10:
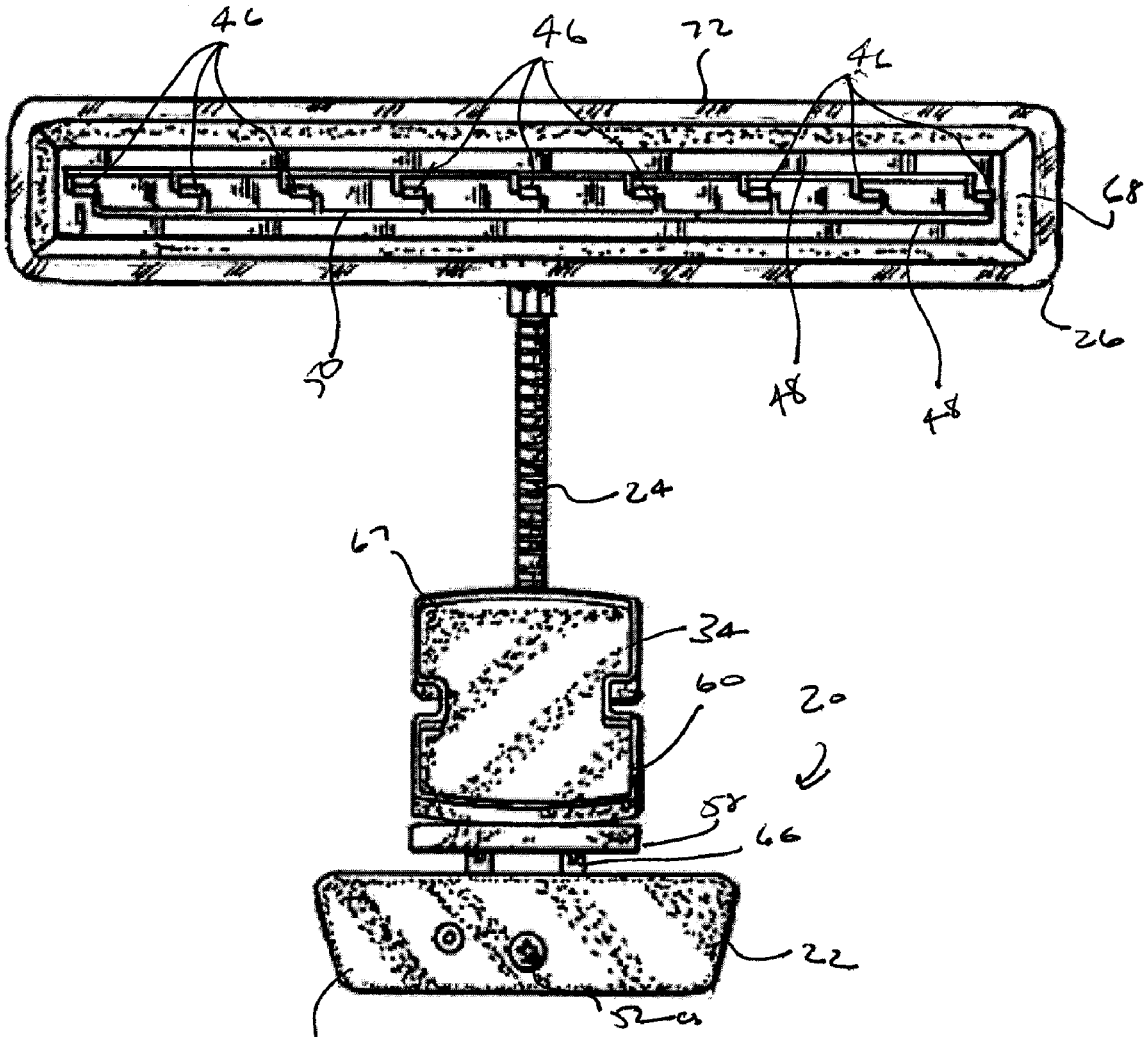
FIG. 10 is a bottom plan view of the LED lamp depicted in FIG. 8.

LEDs. 46 may be surface mounted on printed circuit board 48, which has traces 50 for electrically connecting LEDs 46 in parallel. Printed circuit board 48 is mounted within shade 26 as depicted in FIGS. 2 and 10, and traces 50 are in turn electrically connected with regulator and light circuit 38 via wires 52 extending through gooseneck 24.

Regulator integrated circuit U2 may be a National Semiconductor LP3982IMM micropower, ultra-low dropout CMOS regulator available from Digi-Key Corporation, 701 Brooks Avenue South, Thief River Falls, Minn., under the designation LP3982IMM-ADJCT. According to an embodiment of the invention, regulator integrated circuit U2, which also may be any suitable prepackaged regulator as may be known in the art, converts the higher voltage of battery 32 to a lower voltage for driving LEDs 46. While the voltage from battery 32 can range from a low value of approximately 3.5 volts to a larger value of approximately 10 volts, regulator integrated circuit U2 maintains a nominal drive voltage of 3.25 volts to LEDs 46.

To alleviate potential "thermal runaway" and resultant destruction of LEDs 46, regulator and light circuit 38 incorporates an LED current monitoring circuit which reduces the drive voltage applied to LEDs 46 as the temperature of LEDs 46 rises, thereby reaching a stable condition. The current monitoring circuit includes a low-valued, current-sensing resistor, designated Rtemp in FIG. 11, which is connected in series with LEDs 46 and which is also connected in a feedback loop to adjust input Adj of regulator integrated circuit U2. In operation, as the temperature of LEDs 46 increases, the feedback loop through Rtemp applies a biasing signal to the Adj input of regulator integrated circuit U2. Based on logic within regulator integrated circuit U2, the output voltage from regulator integrated circuit U2 is decreased, thereby decreasing the drive voltage and resulting current through LEDs 46. Another benefit of the current monitor circuit is to reliably operate LEDs 46 near their maximum current rating so to provide the maximum amount of light output from LEDs 46. Rechargeable battery 32 exhibits a declining voltage as its energy is consumed by LEDs 46. Without regulator integrated circuit U2 and the feedback loop, the effect would be for the light intensity of LEDs 46 to decline as the battery voltage declines. With regulator integrated circuit U2 and the feedback loop, however, the light intensity of LEDs 46 is maintained until rechargeable battery 32 is nearly entirely depleted. Hence, operation time of LED lamp 20 is extended between recharges, and rechargeable battery 32 is more fully depleted between recharges, enabling longer battery life due to avoidance of "memory" in the battery.

On/off/intensity switch 48 is connected in series between rechargeable battery 32 and LEDs 46 to enable LED lamp 20 to be turned on and off as well as set to a desired brightness level. In the depicted embodiment, switch 48 is a three position switch having an off position, a first on position and a second on position. In one or both of the on positions, a resistor (not depicted) is connected in series with switch 48 to limit the voltage applied to regulator integrated circuit U2 and accordingly LEDs 46, thereby enabling selection of different illumination levels for LED lamp 20. It will be appreciated that a switch with any number of discrete positions, each connected with a resistor having a different resistance value, could be provided in order to provide any number of different illumination levels. Further, it will be appreciated that a continuously variable analog or digital potentiometer could be substituted for switch 48 to provide still more variability in light output.

Brackets 50*a* are coupled at each end of circuit board assembly 30. Each bracket 50*a* is attachable to housing 28 with a fastener 52*a* to secure circuit board assembly 30 in place therein.

Gooseneck 24 is coupled at one end 54 to housing 28 and at an opposite end 56 to shade assembly 26. Gooseneck 24 defines a central lumen (not depicted) through which wires 52 run from printed circuit board 48 in shade 26 to regulator and light circuit 38 within housing 28. Gooseneck 24 is selectively shapable to enable selective positioning of shade 26 in nearly any orientation. Gooseneck 24 may be any suitable hollow, selectively shapable, lightweight gooseneck element as is commonly known in the art.

Figure 9:
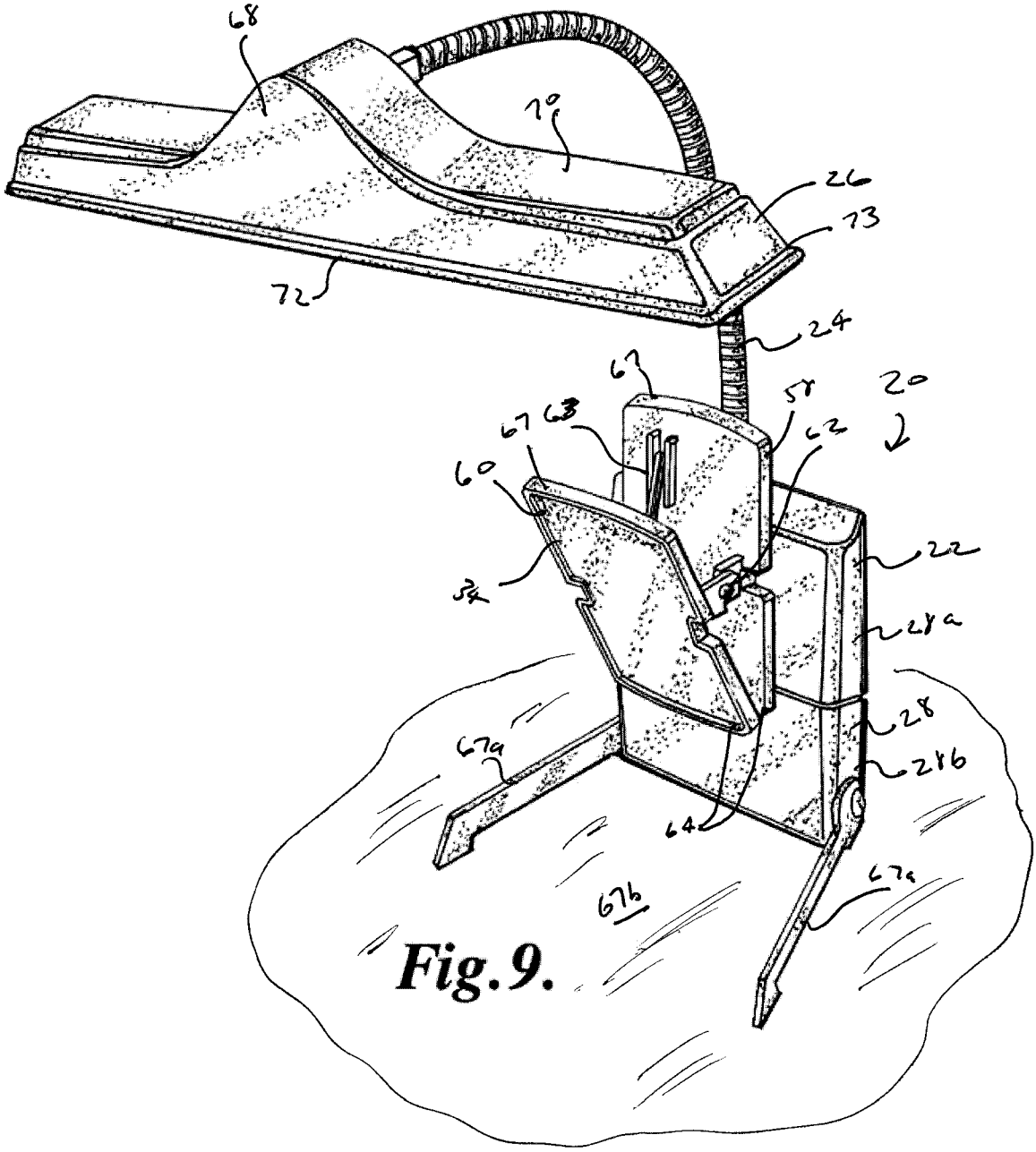
FIG. 9 is a perspective view of an alternate embodiment of an LED lamp according to the present invention.

In an embodiment, attachment element 34 generally includes bayonet portion 58 and opposing portion 60 which are coupled at a pivot 62. Spring 63 biases portions 58, 60, together at ends 64. Bayonet portion 58 is received in bayonet brackets 66 on housing 28. In operation, a user may force ends 64 apart by pressing ends 67 toward each other against the bias of spring 63. Attachment element 34 may then be clamped clothespin fashion on any object that will fit between ends 64 when forced apart. As an alternative to this bayonet arrangement, housing 28 may be equipped with shiftable legs 67*a* as depicted in FIGS. 1, 2-7, and 9. Legs 67*a* are selectively positionable in a first position adjacent housing 28 as depicted in FIGS. 1, 2-7, and a second position as depicted in FIG. 9 when desired to enable LED lamp 20 to stand on a flat surface 67*b*.

Shade assembly 26 generally includes unitary housing 68, which defines enclosure 70 for containing printed circuit board 48 with LEDs 46. Housing 68 may be formed in a single integral piece from suitable lightweight polymer or other material. Preferably, housing 68 is of sufficient depth to receive substantially all of printed circuit board 48 therein. Lower edge flange 72 extends around periphery 73 of enclosure 70 below printed circuit board 48 to provide lateral containment of the light emitted from LEDs 46. The distance lower edge flange 72 extends below printed circuit board 48 may be selected to provide the desired spread of light under shade assembly 26.

Figure 8:
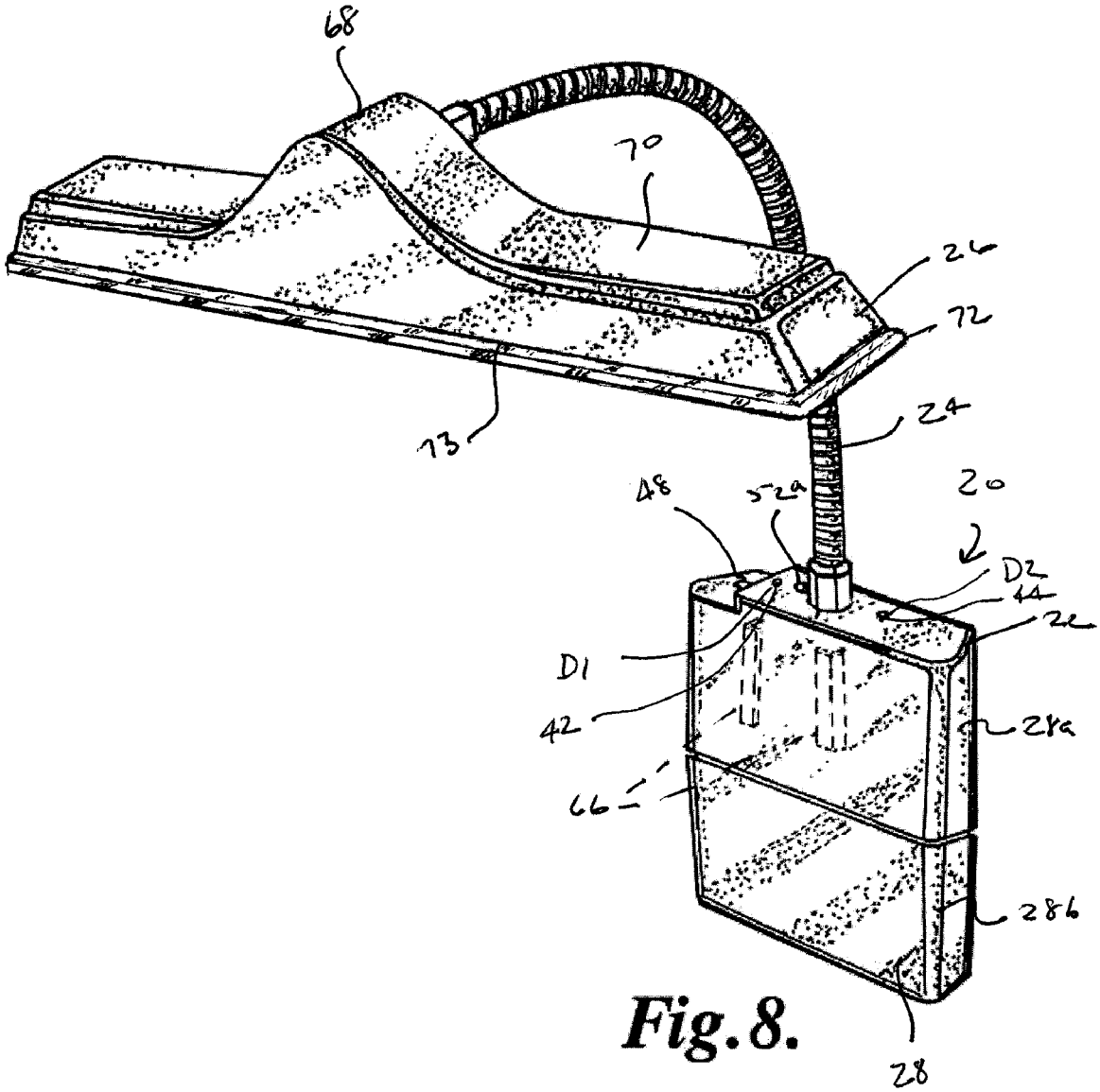
FIG. 8 is a perspective view of an alternate embodiment of an LED lamp according to the present invention.

In embodiments of the invention, as depicted in FIGS. 1-7, and 9, shade assembly 26 including enclosure 70 and lower edge flange 72 are generally opaque to provide maximum control of the spread of light from LEDs 46. In other embodiments, as depicted in FIGS. 8 and 10, lower edge flange 72 may be made from translucent or transparent plastic, either clear or with color. The translucent or transparent lower edge flange 72 refracts light emitted from LEDs 46 so as to appear luminescent, forming a neon-like ring around the lower edge of enclosure 70. For example, lower edge flange 72 may be made from translucent cobalt blue plastic so as to form a luminescent cobalt blue ring around the lower edge of enclosure 70 when LEDs 46 are lit. The effect may particularly pronounced in low ambient light conditions, so as to give the effect of a luminescent halo suspended in the air. Moreover, in an embodiment, translucent or transparent lower edge flange 72 may tend to transmit a refracted view of each individual LED so as to give an appearance of multiple brighter light points within the generally luminescent flange. It will be appreciated that, in addition to the translucent or transparent lower edge flange described above, any other portion of shade assembly 26 may be made translucent or transparent as desired to lend any particular desired lighting effect.

Figure 12:
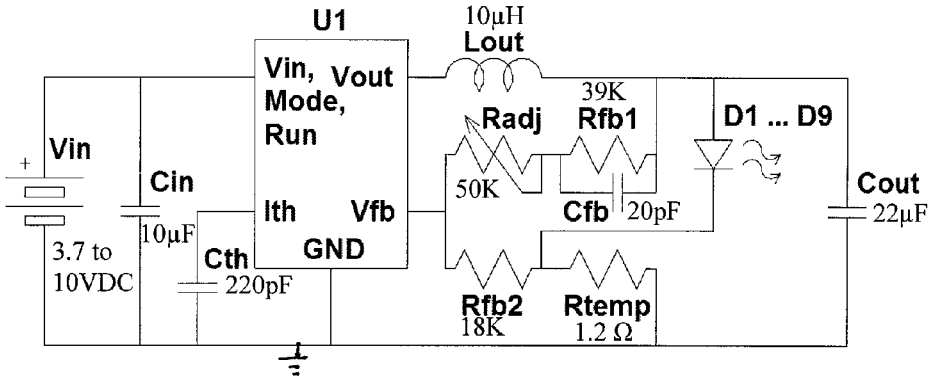
FIG. 12 is a schematic diagram of a circuit board assembly of an alternative embodiment of an LED lamp according to the present invention.

In an alternative embodiment of the LED lamp 20 of the invention, battery 32 may be non-rechargeable such as one or more standard alkaline batteries. FIG. 12 is a schematic depiction of a regulator and light circuit 78 for non-rechargeable batteries. Circuit 78 includes a step-down DC voltage switching regulator IC U1, which may be the National Semiconductor LP3982IMM unit used with regulator and light circuit 38, or any other suitable prepackaged regulator as may be known in the art. Again, voltage switching regulator IC U1 converts the higher voltage of the battery power source to the lower drive voltage required to drive LEDs 46, denoted as D3-D11. While the voltage from battery 32 can range from a low value of approximately 3.5 volts to a larger value of approximately 10 volts, regulator integrated circuit U2 maintains a nominal drive voltage of 3.25 volts to LEDs 46.

Again, to alleviate potential "thermal runaway" and resultant destruction of LEDs 46, regulator and light circuit 78 incorporates an LED current monitoring circuit which reduces the drive voltage applied to LEDs 46 as the temperature of LEDs 46 rises, thereby reaching a stable condition. The current monitoring circuit includes a low-valued, current-sensing resistor, designated Rtemp in FIG. 12, which is connected in series with LEDs 46 and which is also connected in a feedback loop to adjust input Vfb of voltage switching regulator IC U1. In operation, as the temperature of LEDs 46 increases, the feedback loop through Rtemp applies a biasing signal to the Vfb input of voltage switching regulator IC U1. Based on logic within voltage switching regulator IC U1, the output voltage from voltage switching regulator IC U1 is decreased, thereby decreasing drive voltage and corresponding current through LEDs 46. Another benefit of the current monitor circuit is to reliably operate LEDs 46 near their maximum current rating so to provide the maximum amount of light output from LEDs 46. Non-rechargeable battery 32 exhibits a declining voltage as its energy is consumed by LEDs 46. Without regulator integrated circuit U2 and the feedback loop, the effect would be for the light intensity of LEDs 46 to decline as the battery voltage declines. With regulator integrated circuit U2 and the feedback loop, however, the light intensity of LEDs 46 is maintained until non-rechargeable battery 32 is nearly entirely depleted. The regulator and light circuit 78 of the present invention may enable the extraction of over 90% of the useful energy in a standard alkaline battery 32 without causing significant dimming of LEDs 46, enabling longer operation times on a set of batteries and lower overall battery cost.

The embodiments above are intended to be illustrative and not limiting. Additional embodiments are within the claims. Although the present invention has been described with reference to particular embodiments, workers skilled in the art will recognize that changes may be made in form and detail without the departing from the spirit and scope of the invention.

What is claimed is:

1. An LED lamp apparatus comprising a plurality of light emitting diodes arranged in a lighting array;

a substantially opaque shade assembly defining an enclosure with an open side, the lighting array received within the enclosure with the plurality of light emitting diodes facing outwardly through the open side; and a power pack assembly electrically operably connected with the plurality of light emitting diodes to provide power for selectively illuminating the plurality of light emitting diodes, the power pack assembly including a battery, a regulator circuit and a current monitoring circuit, the battery electrically operably coupled with the plurality of light emitting diodes, the regulator circuit, and the current monitoring circuit, wherein the current monitoring circuit monitors a magnitude of electrical current flowing through the plurality of light emitting diodes and communicates a signal indicative of the magnitude of electrical current to the regulator circuit, and wherein the regulator circuit adjusts a magnitude of drive voltage applied to the plurality of light emitting diodes based on the signal such tht a magnitude of light energy emitted frrom the plurality of light emitting diodes is maintained substantially constant as the battery is discharged.

2. The LED lamp apparatus of claim 1, further comprising a housing defining an enclosure and wherein the power pack assembly is received in the enclosure.

3. The LED lamp apparatus of claim 2, further comprising a flexible, selectively positionable gooseneck extending between the shade assembly and the housing, wherein the shade assembly is selectively positionable relative to the housing with the gooseneck.

4. The LED lamp apparatus of claim 1, wherein the open side of the enclosure of the shade assembly defines a periphery, and wherein a translucent or transparent lower edge flange extends around at least a portion of the periphery.

5. The LED lamp apparatus of claim 1, wherein the battery is rechargeable.

6. The LED lamp apparatus of claim 5, wherein the battery is lithium-ion.

7. The LED lamp apparatus of claim 1, wherein the battery is non-rechargeable.

8. The LED lamp apparatus of claim 7, wherein the battery includes an alkaline cell.

9. The LED lamp apparatus of claim 1, further comprising an attachment element for operably coupling the LED lamp apparatus to another article.

10. The LED lamp apparatus of claim 1, wherein the plurality of light emitting diodes produces light of a generally white color.

11. An LED lamp apparatus comprising:

a plurality of light emitting diodes arranged in a lighting array;

a substantially opaque shade assembly defining an enclosure with an open side, the lighting array received within the enclosure with the plurality of light emitting diodes facing outwardly through the open side; and a power pack assembly electrically operably connected with the plurality of light emitting diodes to provide power for selectively illuminating the plurality of light emitting diodes, the power pack assembly including a battery, current monitoring means for monitoring a magnitude of electrical current flowing through the plurality of light emitting diodes, and regulator means for adjusting a magnitude of drive voltage applied to the plurality of light emitting diodes, wherein the current monitoring means is arranged to communicate to the regulator circuit a signal indicative of the magnitude of electrical current flowing through the plurality of light emitting diodes and wherein the regulator circuit adjusts the magnitude of drive voltage applied to the plurality of light emitting diodes based on the signal such tht a magnitude of light energy emitted frrom the plurality of light emitting diodes is maintained substantially constant as the battery is discharged.

12. The LED lamp apparatus of claim 11, further comprising a housing defining an enclosure and wherein the power pack assembly is received in the enclosure.

13. The LED lamp apparatus of claim 12, further comprising a flexible, selectively positionable gooseneck extending between the shade assembly and the housing, wherein the shade assembly is selectively positionable relative to the housing with the gooseneck.

14. The LED lamp apparatus of claim 11, wherein the open side of the enclosure of the shade assembly defines a periphery, and wherein a translucent or transparent lower edge flange extends around at least a portion of the periphery.

15. The LED lamp apparatus of claim 11, wherein the battery is rechargeable.

16. The LED lamp apparatus of claim 15, wherein the battery is lithium-ion.

17. The LED lamp apparatus of claim 11, wherein the plurality of light emitting diodes produces light of a generally white color.

18. A portable LED lamp comprising a plurality of light emitting diodes arranged in a lighting array;

a battery;

a regulator circuit; and a current monitoring circuit, the battery electrically operably coupled with the plurality of light emitting diodes, the regulator circuit, and the current monitoring circuit, wherein the current monitoring circuit monitors a magnitude of electrical current flowing through the plurality of light emitting diodes and communicates a signal indicative of the magnitude of electrical current to the regulator circuit, and wherein the regulator circuit adjusts a magnitude of drive voltage applied to the plurality of light emitting diodes based on the signal such tht a magnitude of light energy emitted frrom the plurality of light emitting diodes is maintained substantially constant as the battery is discharged.

19. The portable LED lamp of claim 18, further comprising a substantially opaque shade assembly defining an enclosure with an open side, the lighting array received within the enclosure with the plurality of light emitting diodes facing outwardly through the open side.

20. The portable LED lamp of claim 19, wherein the open side of the enclosure of the shade assembly defines a periphery, and wherein a translucent or transparent lower edge flange extends around at least a portion of the periphery.

* * * * *